US005383244A

United States Patent [19]

Ahrens et al.

[11] Patent Number: 5,383,244

[45] Date of Patent: Jan. 24, 1995

[54] MULTI-BRUSH DENTURE CLEANING DEVICE

[75] Inventors: Patricia Ahrens, 2217 Knollhaven, Simi Valley, Calif. 93065; Patrick J. Masse, Woodland Hills, Calif.

[73] Assignee: Patricia Ahrens, Simi Valley, Calif. ; a part interest

[21] Appl. No.: 121,067

[22] Filed: Sep. 13, 1993

[51] Int. Cl.[6] ..... A46B 9/04

[52] U.S. Cl. ..... 15/106; 15/167.1; D4/106

[58] Field of Search ..... D4/105, 106, 119, 112; 15/106, 167.1, 167.2

[56] References Cited

U.S. PATENT DOCUMENTS

| | | | |
|---|---|---|---|
| D. 279,049 | 6/1985 | Putkonen | D4/106 |
| 348,508 | 8/1886 | Barber | 15/167.2 |
| 1,813,076 | 7/1931 | Newell | 15/167.1 |
| 2,190,277 | 2/1940 | Viragh | 15/106 |
| 2,206,542 | 7/1940 | Arnold | 15/106 |
| 2,208,013 | 7/1940 | Baker | 15/106 |
| 2,511,235 | 6/1950 | Arwood | 15/106 |

FOREIGN PATENT DOCUMENTS

| | | | |
|---|---|---|---|
| 129445 | 7/1919 | United Kingdom | 15/106 |
| 0021184 | 5/1936 | United Kingdom | 15/167.2 |

*Primary Examiner*—David A. Scherbel
*Assistant Examiner*—Randall E. Chin
*Attorney, Agent, or Firm*—Greer, Burns & Crain, Ltd.

[57] ABSTRACT

A multi-brush denture cleaning device includes a handle having one end adapted for holding both a first and second brush and another opposing end for holding a different third brush. The first brush has bristles protruding in one direction, and the second brush has bristles protruding in a perpendicular orientation with respect to the first brush. The third brush has bristles protruding in the same direction as the first brush. The handle may include a hand grip portion interposed between the two ends thereof. The brushes in the multi-brush denture cleaning device have varying stiffness so that the first and second brushes are harder than the third brush. The handle has two extending portions which are each at acute angles with respect to the longitudinal axis of the handle, and preferably being acutely angled with respect to each other, wherein one extending portion holds the first brush and the second extending portion holds the second brush. Each of the brushes has a different average bristle length.

9 Claims, 3 Drawing Sheets

MULTI-BRUSH DENTURE CLEANING DEVICE

BACKGROUND OF THE INVENTION

The invention relates generally to devices for cleaning teeth and relates more particularly to multi-brush devices for cleaning dentures.

Dentures are typically three dimensional molds that include a denture base and teeth. The intaglio of the denture base of an upper denture includes the outer palate area which has small rugae (ridges and grooves) that coincide with the palette ridges and grooves of the roof of the mouth. The gums of the upper denture are formed by an upwardly extending flange that has high or low palate grooves. Generally, the intaglio of the denture base of the lower denture includes a "U" shaped gum channel formed by an inner lingual flange and an outer facial flange. Given the complex shapes and contours of these various parts of the denture, conventional tooth brushes are not generally suited to adequately clean dentures since these brushes are often too soft or too wide so that hardened matter is difficult to remove. The wide brushes do not adequately fit into small palette grooves or the rugae in the "U" shaped gum channel. Therefore, denture cleaning brushes have been designed in an effort to overcome these problems.

One such denture cleaning brush shown in FIG. 1 has a curved handle 12 with a curved brush 14 and an opposing circular tapered brush 16 both at a same end thereof. The curved brush 14 has tapered outer bristles 18 and generally flat inner bristles 20. The curved brush 14 is curved to match the curved shape of the denture. The circular tapered brush 16 includes stiff filaments to penetrate between teeth. Although such a multi-brush denture cleaning device may be an improvement for cleaning dentures compared to conventional single brush tooth brushes, such a brush 10 is not generally adapted to suitably fit in gum crevices and gum channels since the diameter of the circular brush may be too large. Also, the bristles project in the same direction as the teeth but palette grooves in the gum channels may extend longitudinally in the gum channel. Therefore, the palette grooves are generally not cleaned by the downward extending bristle tips of conventional brushes. In addition, such a brush 10 requires a user to flip the brush over 180 degrees to use the opposing brush. Continuous opposing rotation during cleaning can become cumbersome.

SUMMARY OF THE INVENTION

Accordingly, it is a general object of the present invention to provide an improved denture cleaning brush.

It is a further object of the invention to provide an improved multi-brush denture cleaning device which facilitates cleaning of palette grooves and gum channels of dentures.

It is also an object of the present invention to provide a multi-brush denture cleaning device which requires less rotational movement to change from use between one brush and another provides improved leverage to facilitate brushing.

A multi-brush denture cleaning device includes a handle having one end adapted for holding a first and second brush and another opposing end for holding a different third brush. The first brush has bristles protruding in one direction, and the second brush has bristles protruding in a direction substantially perpendicular with respect to the bristles in the first brush. The third brush has bristles protruding in the same direction as the bristles in the first brush. The handle may include a ribbed hand grip portion interposed between the two ends thereof to facilitate grasping by a user.

The brushes in the multi-brush denture cleaning device have varying stiffness so that the first and second brushes are stiffer than the third brush. Each brush has bristles of a different length. The first brush includes two rows of short, stiff, tapered bristles for cleaning palette grooves in the gum channels. The second brush, which is adapted for cleaning the gum crevices in the bottom of gum channels, is formed by two rows of longer tapered bristles. The third brush has many rows of yet longer bristles for cleaning easy to reach denture areas such as general palette areas and outer surfaces of teeth.

In a more particular embodiment, the handle has two extending portions at one end. The extending portions are each at acute angles with respect to the longitudinal axis of the handle, and preferably being acutely angled with respect to each other, wherein one extending portion holds the first brush and the second extending portion holds the second brush. The bristles of the second brush are acutely angled with respect to the longitudinal axis of the handle to provide improved leverage for the user when brushing gum channels.

DESCRIPTION OF THE PREFERRED EMBODIMENT

Figure 2:
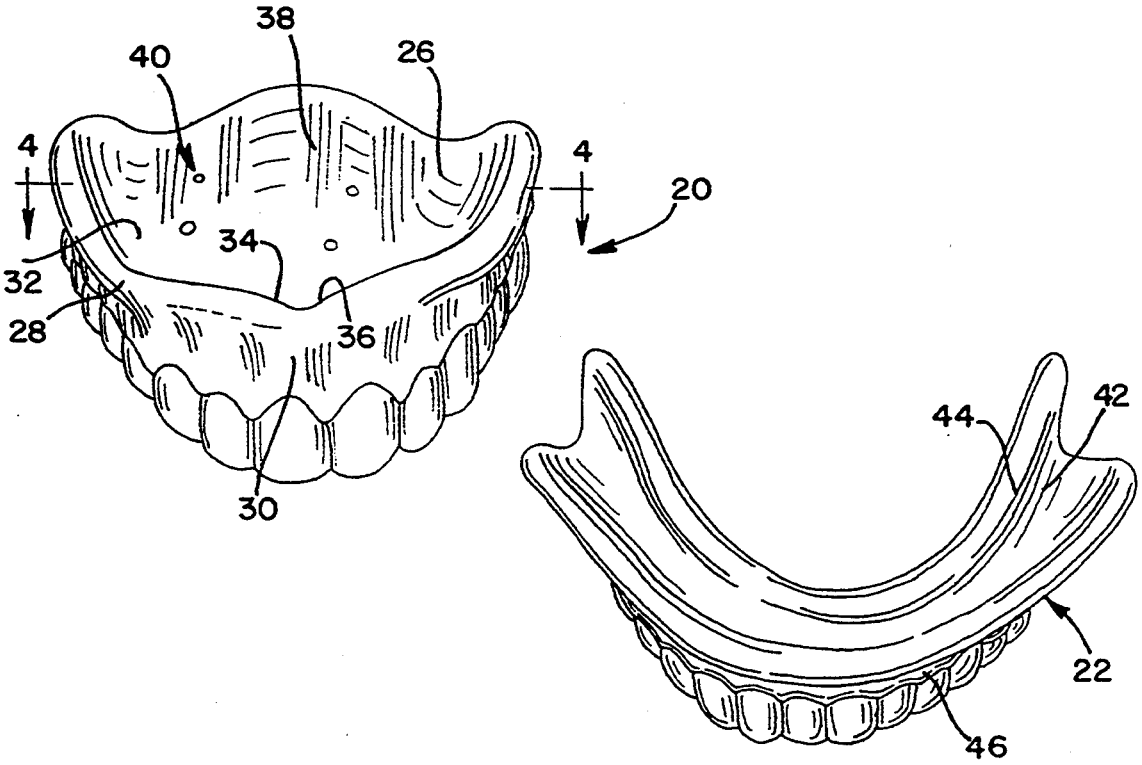
FIG. 2 is a perspective view upper and lower dentures.
Figure 3:
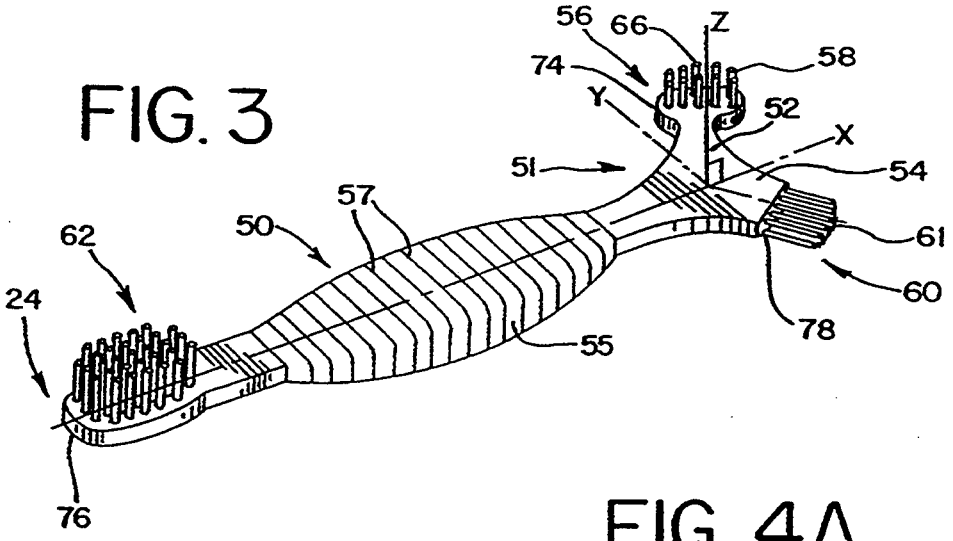
FIG. 3 is a perspective view of a multi-brush denture cleaning device in accordance with the invention.

FIG. 2 depicts a top denture 20 and a bottom denture 22, which may be cleaned by the multi-brush denture cleaning device 24 (see FIG. 3). As shown, the intaglio of the top denture 20 has a top palette surface 26 and upwardly extending flange 28. The gum area 30 is formed by the upwardly extending flange 28. The top palette surface 26 includes an upper gum channel 32 for receiving the upper jaw of a user.

The rugae of the top denture includes palate grooves 34 in an inner side surface 36 of the upwardly extending flange 28. The top palate surface 26 has roof crevices 38 down the center thereof. Various other crevices and grooves, generally indicated at 40 are also located on the top surface 26 of the denture. The aforementioned rugae correspond with actual indentations and crevices formed from a user's mouth during the denture molding process.

The intaglio of the bottom denture 22 includes a lower gum channel 42 adapted for receiving the lower jaw of the user. The gum channel 42 is defined by a lingual flange 44 and an opposing facial flange 46. As shown, the outer contour of the upper and lower dentures is substantially a "C" shape.

Referring to FIGS. 3 and 4A–4C the multi-brush denture cleaning device 24 has a handle 50 with one end 51 having a first extending portion 52 and a second extending portion 54 each being in acute angled arrangement with respect to the longitudinal axis of the handle, and preferably being acutely angled with respect to each other. The handle 50 includes a center grip portion 55 having a substantially oval cross section to facilitate easy grasping by a user's hand. The center grip portion 55 has a grooved outer surface 57 for reducing slippage when the handle is wet. The handle 50 decreases in thickness from the center of the handle to its ends.

Figure 4A:
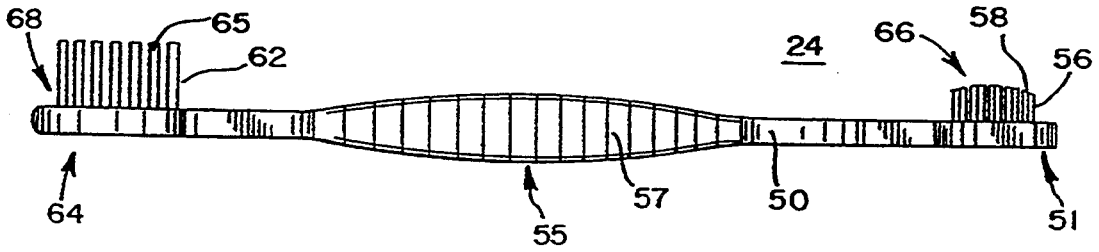
FIG. 4A is a right side view of the inventive multi-brush denture cleaning device.
Figure 4B:
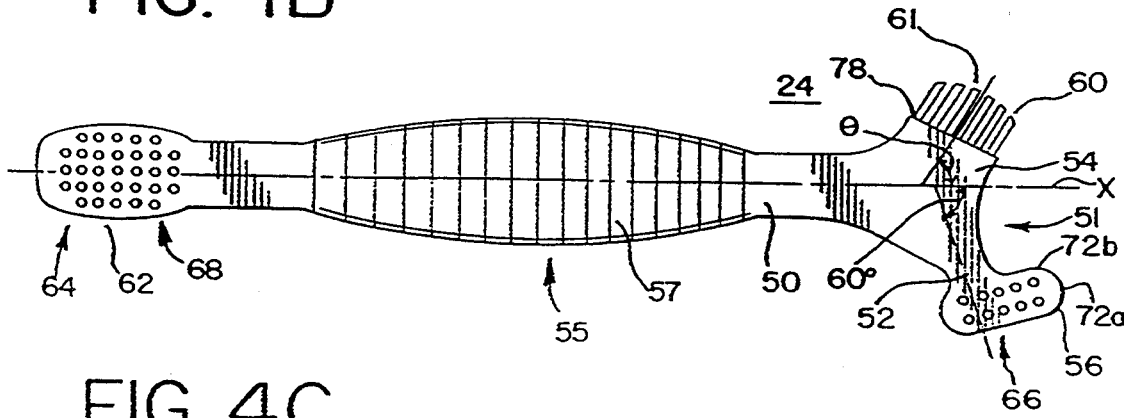
FIG. 4B is a bottom view of the multi-brush denture cleaning device.
Figure 4C:
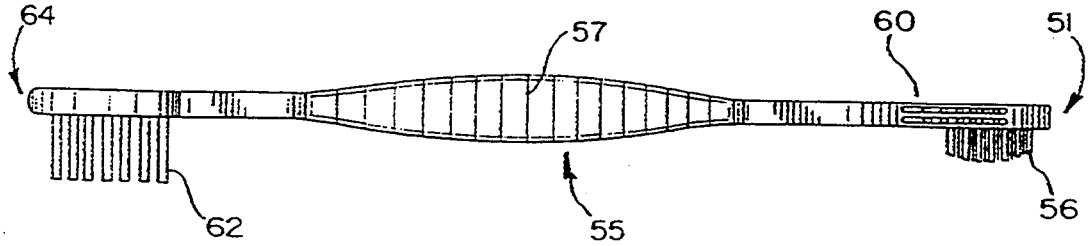
FIG. 4C is a left side view of the multi-brush denture cleaning device.

A first brush 56 at an end 51 of the first extending portion 52 has two rows of centrally tapered bristles 58 protruding in a vertical direction Z. The centrally tapered bristles 58 have outer ends that form a convex surface, as shown in FIG. 4A. The preferred average length of the bristles in the first brush 56 is approximately 5 mm. However, the average length of the bristle may be between 3 mm and 6 mm. The first extending portion is acutely angled at approximately 60 degrees with respect to the longitudinal X axis as shown.

A separate second brush 60 located at the same end 51 and connected at an end of the second extending portion 54 has two rows of centrally tapered bristles 61 having a convex outer brushing surface protruding in a horizontal direction perpendicular to the bristles 58 of the first brush 56. As shown in FIG. 3, the tapered bristles 61 are angled within the horizontal X-Y plane to preferably be at approximately an acute angle with respect to the longitudinal center axis X of the handle 50. The angle of the bristles of the second brush may be an angle $\theta$, wherein $\theta$ can be between 5° and 85° with respect to the longitudinal axis X of the device. The average length of the bristles in the second brush 60 is approximately 12 mm.

A third brush 62 located at a distal opposing end 64 from the first and second brushes 56 and 60 respectively, has many rows of bristles 65 protruding in the same vertical direction as the bristles 58 of the first brush 56. The average length of the bristles in the third brush is approximately 15 mm. The diameter of each bundle is approximately 2 mm.

Each of the bundles of bristles 66 forming the first brush 56 have a heavier weight (harder) than those forming the third brush 62. The weight of the bundles in the first brush 56 and the second brush 60 are approximately the same. It is preferred that each bundle in the two rows of bundles of bristles in the first brush 56 and the second brush 60 have a diameter of approximately 1.5 mm.

A head 74 of the first brush 56 has a thickness of approximately 3 mm to facilitate cleaning of the gum channel 42. The head 74 lies substantially perpendicular to a line located at the 60 degree angle to facilitate improved leverage during brushing. A head 76 of the third brush has an oval shape and has the same thickness as the first brush. The large width of the head of the third brush 62 facilitates flat surface scrubbing such as scrubbing of the palette areas and teeth. A head 78 of the second brush 60 has a same cross section as the second extending portion 54 which may be approximately 3 mm. However, it will be recognized that any suitable shapes for the heads may be used.

Each of the brushes has a different average bristle length since each brush is uniquely designed to clean different areas of the denture. As previously indicated, the first brush 56 has the shortest bristles, the second brush 60 has longer bristles, and the third brush 62 has the longest bristles. The tapered bristles in the first and second brushes allow each brush to contact less surface area within the channels and rugae of the denture so as to increase the brushing force of each brush stroke.

The multi-brush denture cleaning device 24 may be molded from plastic or other suitable material. The grip surface portion 50 may be formed by an outer soft rubber shell. The bristles may be formed in the handle in any suitable manner as known in the art. The handle 50 has a substantially oval cross section taken along the Y axis, and also has a substantially oval cross section taken along the X axis for the area containing a center grip portion. It will be recognized that any other suitable cross sectional shapes may also be used.

Figure 5:
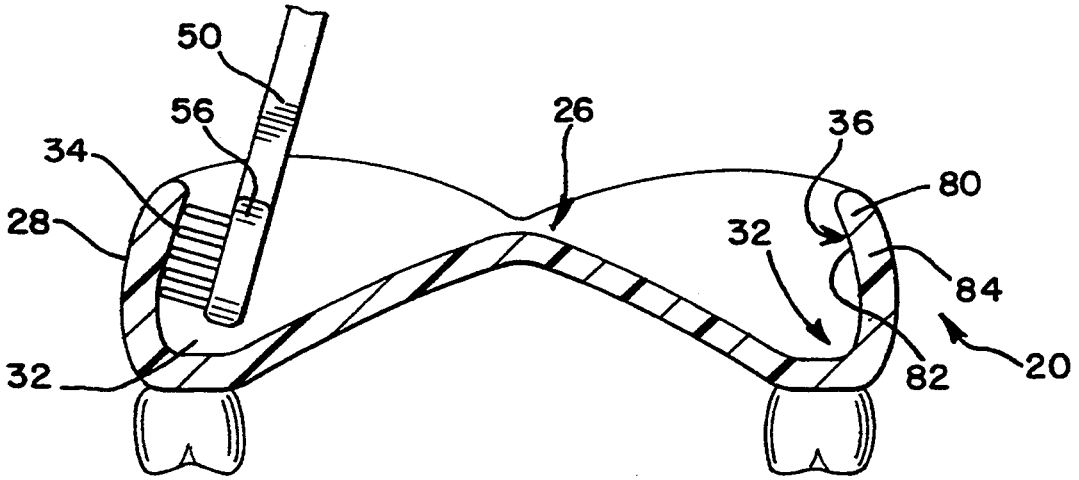
FIG. 5 is a cross section of the upper denture in FIG. 2 along lines 4—4 with the first brush cleaning palette grooves in side surfaces of the flanges forming the gum channels.
Figure 6:
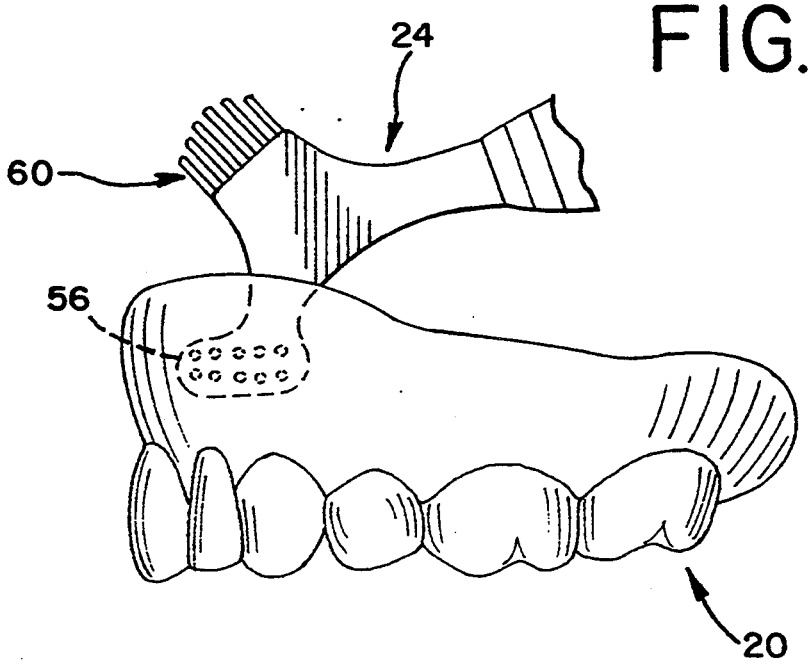
FIG. 6 is a partial perspective view showing the first and second brush when the first brush is being used for denture cleaning.

FIG. 5 shows a cross section taken along lines 4—4 of FIG. 2 and will be used to illustrate how to use the denture cleaning device to clean the various areas of the denture. The first brush 56 is used to clean the palate grooves 34 in the inner side surface 36 of the upwardly extending flange 28. Typically, upper dentures 20 have an inwardly curved flange portion 80 which serves, in part, to provide an adhering surface between the gum of the wearer and denture.

Figure 1:
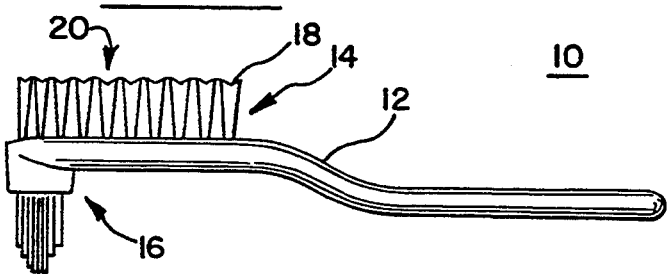
FIG. 1 PRIOR ART
FIG. 1 depicts a known multi-brush denture cleaning device.

With conventional denture cleaning brushes (such as that shown in FIG. 1), it is difficult to clean a crevice 82 between the inwardly extending flange portion 80 and a straighter flange portion 84 particularly since the crevices extend in a longitudinal direction. Also, since two brushes may be positioned back to back with bristles extending in opposing directions, a brush cannot be aligned to have bristles in a parallel direction with respect to the palette grooves 34. However, the first brush 56 has short bristles and a thin head to fit in the gum channel 32 so that the rows of bristles are also in a longitudinal direction in parallel with the crevice 82 and palette grooves 34.

The second brush 60 is used to clean the bottom of the gum channels 32. The overall narrow width of the two rows of bristles allows the brush to reach into the bottom of the gum channels to effectively clean additional palate grooves or other rugae in the bottom of gum channels.

The third brush 64 is used to clean the top palate surface 26 and opposing palate surface as well as the teeth and any other easy to reach areas. The numerous rows of bristles and the wider head allows a greater surface area of the denture to be cleaned with a single brush stroke.

FIG. 5 illustrates the position of the second brush 60, when the first brush 56 is being used to clean palette grooves 34 in the flanges. As shown, the angled head of the second brush 60 is angled so that the second brush does not contact the denture during use of the first brush 56.

Accordingly, the inventive multi-brush cleaning device 24 has a tapered brush for cleaning gum channels and a perpendicular angled tapered brush for cleaning rugae such as crevices in the bottom of gum channels.

The perpendicular orientation between the brushes requires less rotational movement for the user when transferring between these two brushes. The angled orientation of the bristles in the perpendicular direction allows the brush user to acquire greater leverage in brushing compared with non-angled bristles. The wider third brush at the opposing end of the handle facilitates cleaning of open, flatter areas of the denture.

In an alternative embodiment, the first brush may have two straight rows with each row having a series of curved bundles. Each of the bundles may curve in a convex manner toward the handle. Such curved bundles provide additional surface cleaning contact where denture grooves curve in the gum channel.

Specific embodiments of a novel denture cleaning brush has been described for the purposes of illustrating the manner in which the invention is made and used. It should be understood that the implementation of other variations and modifications of the invention, in its various aspects, will be apparent to those of ordinary skill in the art and that the invention is not limited by the specific embodiments disclosed herein. For example, the location of the brushes or cross section of the grip portion may be changed to accommodate different device designs.

What is claimed is:

1. A multi-brush denture cleaning device comprising:
a handle having a longitudinal axis and having a first end for holding a first brush and a separate second brush, and a second end for holding a third brush, the first end of the handle having a first extension portion and a second extension portion acutely angled with respect to each other wherein each extension portion includes one of the first and second brushes;
the first brush having bristles protruding in a first direction;
the second brush having bristles protruding in a second substantially perpendicular direction to the first direction; and
the third brush having bristles protruding in the same direction as the first brush bristles.

2. The denture cleaning device of claim 1 wherein each of the brushes has a different average bristle length such that the first brush has the shortest average bristle length and the third brush has the longest average bristle length.

3. The denture cleaning device of claim 2 wherein the average bristle length of the first brush is between 3 mm and 6 mm.

4. The denture cleaning device of claim 1 wherein bristles of the first brush are formed in at least two rows, each row being centrally tapered to form an outer convex brushing surface.

5. The denture cleaning device of claim 1 wherein bristles of the second brush are formed in at least two rows, each row being centrally tapered to form an outer convex brushing surface.

6. The denture cleaning device of claim 1 wherein the bristles of the third brush are formed in more than two rows.

7. A multi-brush denture cleaning device comprising:
a handle having a longitudinal axis and having a first end for holding a first brush and a separate second brush, and a second end for holding a third brush, the first end of the handle having a first extension portion and a second extension portion acutely angled with each other wherein each extension portion includes one of the first and second brushes;
the first brush having at least two rows of tapered bristles protruding in a first direction;
the second brush having at least two rows of tapered bristles protruding in a second substantially perpendicular direction to the bristles of the first brush; and
the third brush having bristles protruding in the same direction as the bristles of the first brush, wherein each of the brushes has a different average bristle length such that the first brush has the shortest average bristle length and the third brush has the longest average bristle length.

8. The denture cleaning device of claim 7 wherein the average bristle length of the first brush is between 3 mm and 6 mm.

9. The denture cleaning device of claim 8 wherein the bristles of the third brush are formed in more than two rows.

* * * * *